US009371162B2

(12) United States Patent
Walunis et al.

(10) Patent No.: US 9,371,162 B2
(45) Date of Patent: Jun. 21, 2016

(54) ONE-PIECE DISPENSING CLOSURE

(75) Inventors: Steve Walunis, Ravenna, OH (US); Barry Michael Daggett, Austintown, OH (US)

(73) Assignee: WEATHERCHEM CORPORATION, Twinsburg, OH (US)

( * ) Notice: Subject to any disclaimer, the term of this patent is extended or adjusted under 35 U.S.C. 154(b) by 775 days.

(21) Appl. No.: 12/314,368

(22) Filed: Dec. 9, 2008

(65) Prior Publication Data

US 2010/0140304 A1 Jun. 10, 2010

(51) Int. Cl.

*B65D 43/00* (2006.01)
*B65D 47/08* (2006.01)
*B65D 43/16* (2006.01)

(52) U.S. Cl.

CPC ..... *B65D 47/0847* (2013.01); *B65D 43/161* (2013.01); *B65D 2543/0024* (2013.01); *B65D 2543/00092* (2013.01); *B65D 2543/00296* (2013.01)

(58) Field of Classification Search

CPC ..... B65D 43/161; B65D 47/0847; B65D 2543/00092; B65D 2543/0024; B65D 2543/00296
USPC ..... 222/480, 153.01, 153.05, 153.06, 222/153.09, 402.13, 482, 487; 220/556, 220/254.3, 826, 255, 254.2
See application file for complete search history.

(56) References Cited

U.S. PATENT DOCUMENTS 3,160,327 A 12/1964 Porcelli
3,351,242 A * 11/1967 Lodding et al. ..... 222/189.02
3,629,901 A 12/1971 Wolf et al.
4,284,200 A 8/1981 Bush et al.
4,359,171 A * 11/1982 Lewis ..... 220/835
4,361,250 A * 11/1982 Foster ..... 220/266
4,369,901 A 1/1983 Hidding et al.
4,403,712 A 9/1983 Wiesinger et al.
4,454,958 A 6/1984 Juillet et al.
4,457,458 A 7/1984 Heinol et al.
D278,602 S 4/1985 Rosenstein
4,592,480 A * 6/1986 Hart et al. ..... 220/270
4,610,371 A 9/1986 Karkiewicz et al.
4,611,725 A * 9/1986 Kacalieff ..... 220/253
4,693,399 A 9/1987 Hickman et al.
4,723,693 A 2/1988 DeCoster et al.
4,754,898 A * 7/1988 Britt et al. ..... 222/487
4,881,668 A 11/1989 Kitterman et al.
D305,206 S 12/1989 Hickman et al.

(Continued)

FOREIGN PATENT DOCUMENTS

CA 2612843 A1 1/2009

OTHER PUBLICATIONS

OA dated May 20, 2011 for U.S. Appl. No. 12/379,872, 18 pages.

(Continued)

*Primary Examiner* — Kevin P Shaver
*Assistant Examiner* — Robert Nichols, II
(74) *Attorney, Agent, or Firm* — Amin, Turocy & Watson LLP

(57) ABSTRACT

A one-piece dispensing closure is disclosed. The one-piece dispensing closure includes a base, a lid having a first flap and means to irreversibly attach to the base, a first living hinge connecting the base to the lid, and a second living hinge connecting the first flap to the lid. The simplistic design of the dispensing closure allows for easy production of dispensing closures of different shapes and sizes.

16 Claims, 5 Drawing Sheets

(56) References Cited

U.S. PATENT DOCUMENTS

| | | | | |
|---|---|---|---|---|
| 4,915,268 | A | 4/1990 | Lay et al. | |
| 4,936,494 | A | 6/1990 | Weidman | |
| 5,040,695 | A | 8/1991 | Adams et al. | |
| 5,219,100 | A | 6/1993 | Beck et al. | |
| 5,330,082 | A | 7/1994 | Forsyth | |
| 5,447,247 | A * | 9/1995 | Derksen | 215/247 |
| 5,509,579 | A * | 4/1996 | Robbins, III B65D 47/0814 | 222/109 |
| 5,509,582 | A * | 4/1996 | Robbins, III | 222/158 |
| 5,540,343 | A | 7/1996 | Schumacher et al. | |
| 5,762,199 | A * | 6/1998 | Aguilera | 206/533 |
| 5,913,435 | A | 6/1999 | Fuchs et al. | |
| 5,927,535 | A * | 7/1999 | Goth | 220/254.3 |
| 5,938,068 | A | 8/1999 | Atkins et al. | |
| 5,975,368 | A | 11/1999 | Wood et al. | |
| 6,050,434 | A | 4/2000 | McNab | |
| 6,116,477 | A | 9/2000 | Kreiseder et al. | |
| 6,286,731 | B1 | 9/2001 | Lillelund et al. | |
| 6,321,923 | B1 | 11/2001 | Wood et al. | |
| 6,355,335 | B1 | 3/2002 | Kulkaski et al. | |
| RE37,634 | E | 4/2002 | Hickman et al. | |
| 6,364,169 | B1 * | 4/2002 | Knickerbocker | 222/189.02 |
| 6,439,410 | B1 | 8/2002 | Dubach et al. | |
| 6,464,113 | B1 | 10/2002 | Vogel | |
| 6,575,323 | B1 | 6/2003 | Martin et al. | |
| 6,691,901 | B2 | 2/2004 | Parve et al. | |
| 7,007,830 | B2 | 3/2006 | Parve et al. | |
| 7,121,438 | B2 * | 10/2006 | Hoepner et al. | 222/544 |
| D532,298 | S | 11/2006 | Vogel | |
| 7,134,575 | B2 | 11/2006 | Vogel et al. | |
| 7,258,255 | B2 * | 8/2007 | Vogel et al. | 222/556 |
| 7,322,493 | B2 | 1/2008 | Skillin et al. | |
| D582,271 | S | 12/2008 | Vogel | |
| D618,063 | S * | 6/2010 | Davies et al. | D7/614 |
| 7,913,868 | B2 * | 3/2011 | Dolan et al. | 220/254.2 |
| 8,066,158 | B2 | 11/2011 | Vogel et al. | |
| 8,464,886 | B2 * | 6/2013 | Fisher | 220/254.2 |
| 2003/0111495 | A1 | 6/2003 | Parve et al. | |
| 2004/0111836 | A1 | 6/2004 | Lagler et al. | |
| 2006/0011667 | A1 | 1/2006 | Skillin et al. | |
| 2007/0145082 | A1 | 6/2007 | Parve | |
| 2007/0170192 | A1 * | 7/2007 | Blum et al. | 220/826 |
| 2007/0283529 | A1 | 12/2007 | Hashizume et al. | |
| 2008/0110942 | A1 * | 5/2008 | Blomdahl et al. | 222/556 |
| 2008/0257918 | A1 | 10/2008 | Vogel et al. | |
| 2010/0140304 | A1 | 6/2010 | Walunis et al. | |
| 2010/0224643 | A1 | 9/2010 | Daggett et al. | |

OTHER PUBLICATIONS

OA dated Oct. 17, 2011 for U.S. Appl. No. 12/379,872, 15 pages.
OA dated Jan. 3, 2012 for U.S. Appl. No. 12/382,270, 10 pages.
OA dated Jul. 6, 2012 for U.S. Appl. No. 12/382,270, 7 pages.
OA dated Sep. 24, 2012 for U.S. Appl. No. 12/379,872, 17 pages.
Canadian Office Action dated Apr. 4, 2013 for Canadian Patent Application No. 2,701,024, 3 pages.
Final Office Action dated Apr. 12, 2013 for U.S. Appl. No. 12/379,872, 20 pages.
Office Action dated Mar. 25, 2013 for U.S. Appl. No. 12/382,270, 9 pages.
Canadian Office Action dated Apr. 12, 2013 for Canadian Patent Application No. 2,701,019, 3 pages.
Non-Final Office Action dated Jul. 29, 2013 for U.S. Appl. No. 12/379,872, 13 pages.
Canadian Office Action dated Nov. 28, 2013 for Canadian Patent Application No. 2,701,024, 1 page.
Canadian Office Action dated Oct. 9, 2014 for Canadian Patent Application No. 2,688,363, 2 pages.
Non-Final Office Action for U.S. Appl. No. 14/025,758 dated Jul. 8, 2015, 41 pages.

* cited by examiner

ONE-PIECE DISPENSING CLOSURE

FIELD OF THE INVENTION

The invention generally relates to dispensing closures and, in particular, to a one-piece closure with at least one flap for opening and closing a dispensing aperture.

BACKGROUND

Dispensing closures for bottles, cans and other containers frequently have one or more flaps that can be pivoted between open and closed positions to conveniently dispense product from the container without removing the closure. Examples of the general type of closures under consideration here are disclosed in the following U.S. patents, the disclosures of which are incorporated herein by reference: U.S. Pat. Nos. 4,693,399, 4,936,494, 5,330,082 and 6,575,323. The dispensing closures are typically produced by an injection molding process.

There is a continuous demand, however, for dispensing closures that can be produced at low cost with better performance, less mold maintenance, faster cycle, more design flexibility and low capital expenditure.

SUMMARY OF THE INVENTION

A one-piece dispensing closure is disclosed. The one-piece dispensing closure includes a base, a lid having a first flap and means to irreversibly attach to the base, a first living hinge connecting the base to the lid, and a second living hinge connecting the first flap to the lid. In one embodiment, the means to irreversibly attach to the base comprises a positive snap lock on the lid and a matching hole on the base. In another embodiment, the lid comprises a third living hinge connecting a second flap to the lid. In another embodiment, the lid comprises a plurality of living hinges connection a plurality of flaps to the lid. In another embodiment, the flap is maintained in a closed position by a releasable snap-bead structure at the top edge of the lid.

Also disclosed is a container assembly. The container assembly includes a container having a dispensing opening and a one-piece dispensing closure attached to the dispensing opening. The one-piece dispensing closure includes a base; a lid having a first flap, a first living hinge connecting the base to the lid, and a second living hinge connecting the first flap to the lid.

DESCRIPTION OF THE PREFERRED EMBODIMENTS

Figure 2:
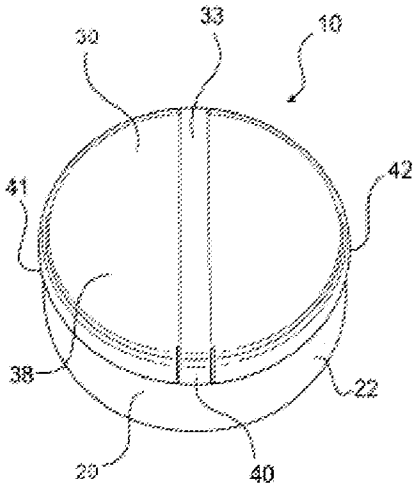
FIG. 2 is a perspective view of the one-piece dispensing closure of FIG. 1 in a fully assembled position with flaps closed.
Figure 1:
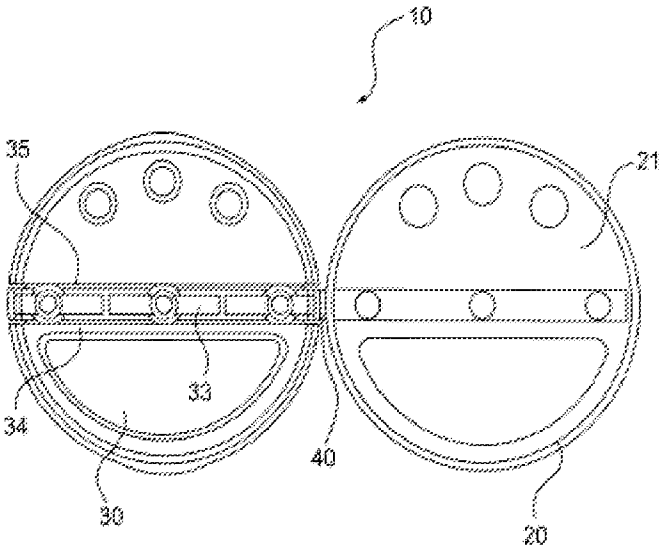
FIG. 1 is a perspective view of an embodiment of the one-piece dispensing closure of the present invention in a "as molded" position.

This description is intended to be read in connection with the accompanying drawings, which are to be considered part of the entire written description of this invention. The drawings are not necessarily to scale and certain features of the invention may be shown exaggerated in scale or in somewhat schematic form in the interest of clarity and conciseness. In the description, relative terms such as "front," "back," "up," "down," "top" and "bottom," as well as derivatives thereof, should be construed to refer to the orientation as then described or as shown in the drawing under discussion. These relative terms are for convenience of description and normally are not intended to require a particular orientation. Terms concerning attachments, coupling and the like, such as "connected" and "attached," refer to a relationship wherein structures are secured or attached to one another either directly or indirectly through intervening structures, as well as both movable or rigid attachments or relationships, unless expressly described otherwise.

Referring now to FIGS. 1-9, there is shown a dispensing closure 10 in an embodiment of the invention. The dispensing closure 10 is a unitary or one-piece structure preferably formed of an injection molded suitable thermoplastic material such as polypropylene. The dispensing closure 10 comprises a base 20, a lid 30, a living hinge 40 that connects the base 20 to the lid 30. The term "living hinge" refers to a hinge integrally formed with two opposite portions of the same material. Typically the material along the living hinge is thin relative to the adjacent areas to facilitate flexing or bending of the opposite portions (i.e., the base 20 and the lid 30). A living hinge allows one portion to bend relative to the other portion, as would other hinges between the two portions. The living hinge 40 allows for a single piece design that can be molded as in-line of draw. No slides or sub-slides are required in the molding design.

The base 20 has a generally circular end wall 21 and a cylindrical skirt 22 depending from the periphery of the end wall. The skirt 22 is formed with internal threads 23 enabling it to be screwed onto a mouth of a container. A lower face or side of the end wall 21 includes a circumferentially continuous sealing surface 24 that registers with and can engage the mouth of a bottle or container. A removable liner (not shown) such as an induction seal liner, may be positioned in the base 20 against the sealing surface 24 prior to assembly of the dispensing closure on a bottle to assure freshness and tamper evidence by causing the liner to seal on the mouth of the container. The base 20 illustrated in FIGS. 1-6 is a two-mode design having a relatively large spoon or pouring opening 26 at one side of the end wall 21, and a plurality of sift or shake openings 27 in an opposite side of the end wall.

The lid 30 contains a pair of flaps 31 and 32. Each of the flaps 31 and 32 selectively opens and closes the pouring opening 26 and shake openings 27, respectively. The flaps 31 and 32 are connected to a chordal or diametral area 33 of the lid 30 by respective living hinges 34 and 35. The term "chordal", as used herein, is intended to cover the special case where the area 33 is symmetrical with a diametral line such as where, as illustrated, the flaps 31 and 32 are essentially of the same size, but also includes arrangements where the flaps are of unequal size and the area is more distinctly offset from a true diametral line. In the illustrated case, the living hinges 34 and 35 are elongated elements that extend along a major portion of the chordal area 33 and the width of the respective flaps. The living hinges 34 and 35 in the illustrated embodiment are parallel to each other. The hinges 34 and 35 comprise relatively thin, small areas of material that connect the flaps 31 and 32 to the chordal area 33.

Figure 4:
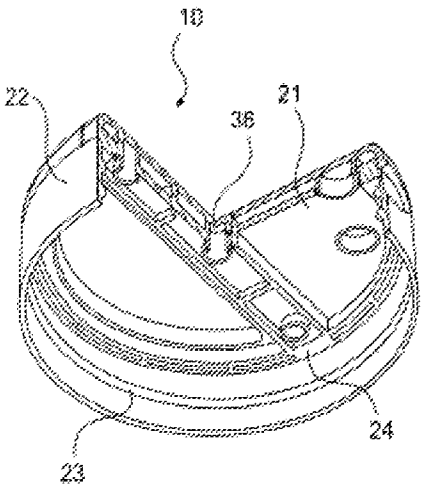
FIG. 4 is another cut-off view of the one-piece dispensing closure of FIG. 2.
Figure 3:
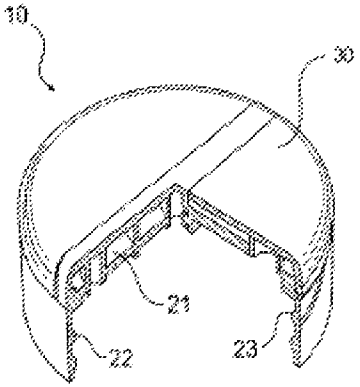
FIG. 3 is a cut-off view of the one-piece dispensing closure of FIG. 2.
Figure 6:
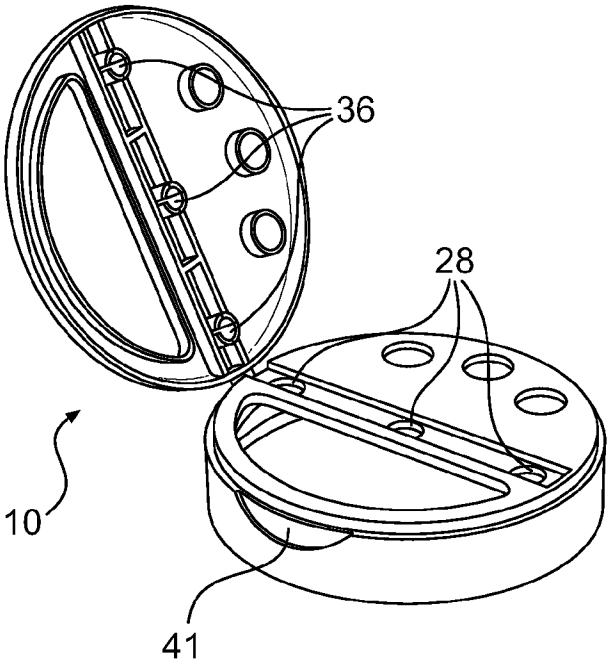
FIG. 6 is a perspective view of the one-piece dispensing closure of FIG. 1 in a half-assembled position with flaps closed.
Figure 5:
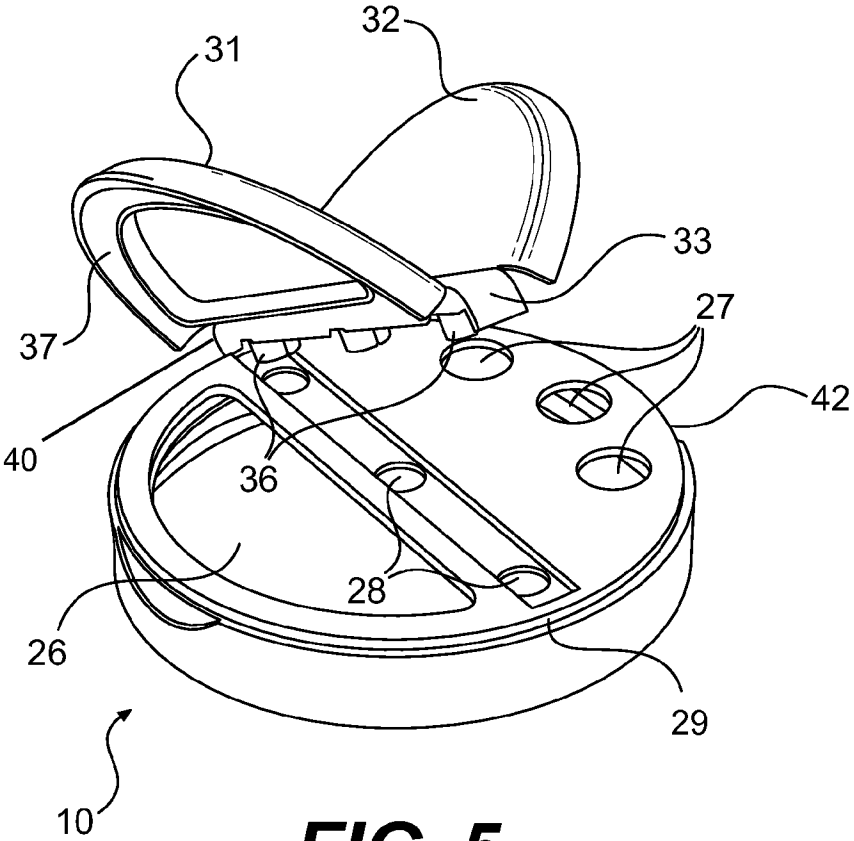
FIG. 5 is a perspective view of the one-piece dispensing closure of FIG. 1 in a half-assembled position with flaps partially open.
Figure 8:
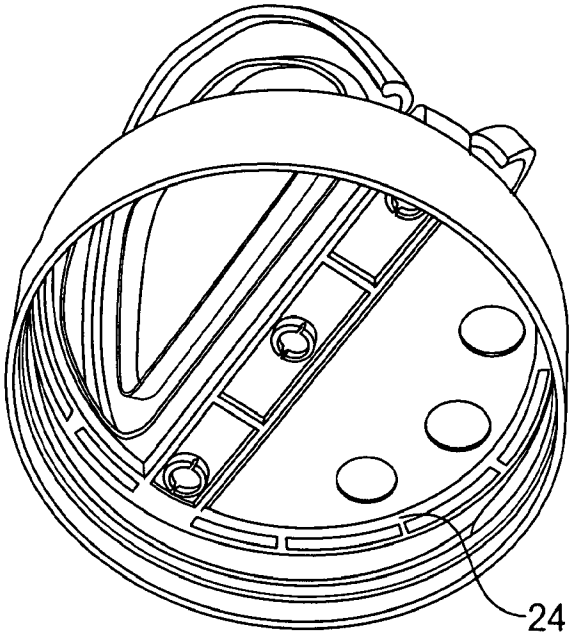
FIG. 8 is a bottom view of the one-piece dispensing closure of FIG. 2 showing the positive snap locks that keep the lid mated to the base.
Figure 7:
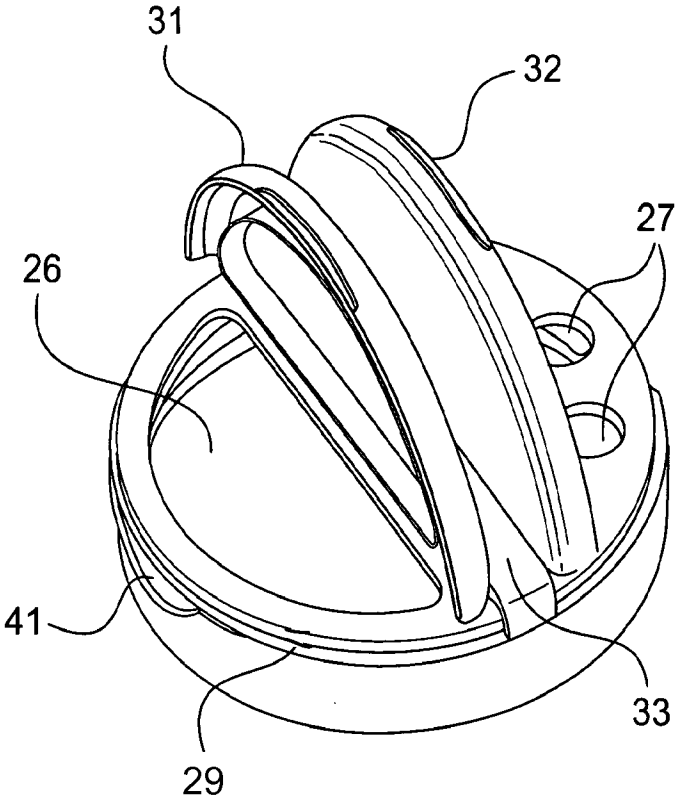
FIG. 7 is a perspective view of the one-piece dispensing closure of FIG. 2 in a fully assembled position with flaps open.

In a as-molded condition, the lid 30 is connected to the base 20 by the living hinge 40. The lid 30 is then folded towards the base 20 and is irreversibly attached to the base 20 via positive snap locks 36. The positive snap locking mechanism is well-known to one skilled in the art. As shown in FIGS. 4 and 6, the positive snap locks 36 are formed in the chordal area 33 on the back side of the lid 30. When the lid 30 is folded towards the base 20, the positive snap locks 36 enter and engage with the corresponding locking holes or slot 28 on the base 20. Once in a lock-in position, the positive snap locks 36 cannot be disengaged unless broken.

A releasable flap catch mechanism, such as the snap-bead design as illustrated, is provided to releasably hold each of the flaps 31 and 32 closed on the end wall 21 to close their respective apertures or openings 26 and 27. The snap-bead catch mechanism includes an edge 29 on the circular end wall 21 that extends slightly over the exterior wall of the cylindrical skirt 22, and a complimentary inward curvature 37 on the edge of the lid 30 that snap catches the edge 29 of the base 20 when the flaps 31 and 32 are in a closed position. The release of the flaps 31 and 32 is facilitated by thumbtabs 41 and 42 formed on the opposite sides of the cylindrical skirt 22.

Figure 9:
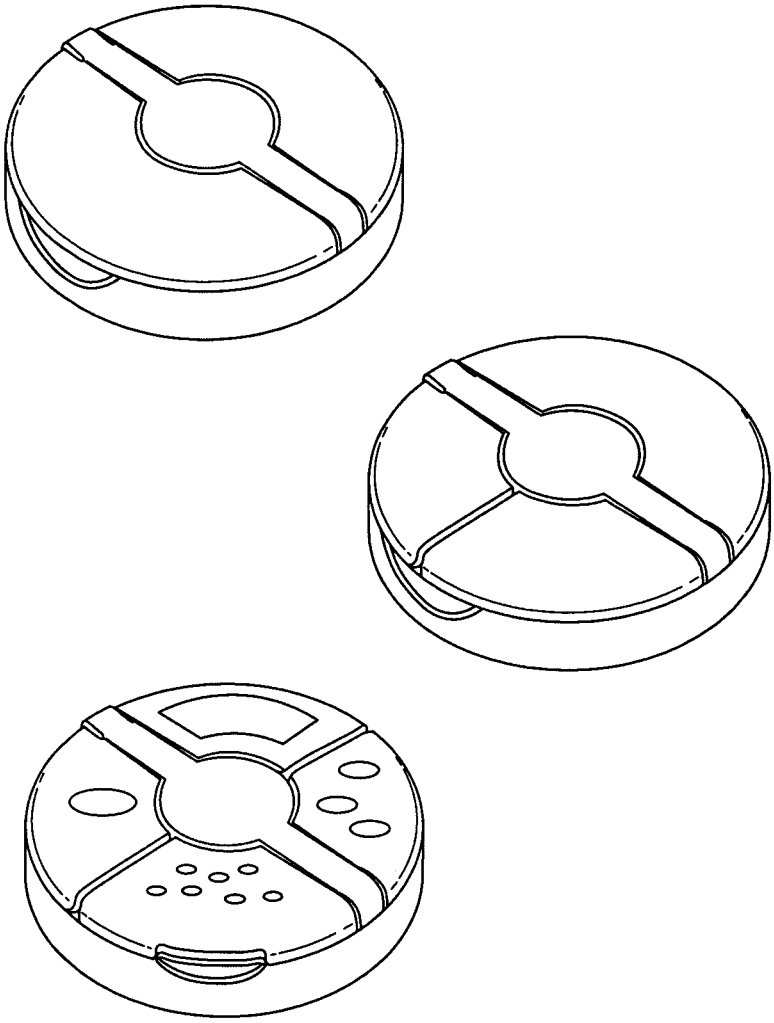
FIG. 9 is a composite drawing showing other embodiments of the one-piece dispensing closure of the present invention.

Although a two-flap design is shown in FIGS. 1-8, one skilled in the art would understand that the dispensing closure 10 can easily adopt a tri-flap or quad-flap design as shown in FIG. 9.

As shown in FIGS. 1-8, the top surface 38 of the lid 30 is free of any structure components and, therefore, can be used for displaying the company name or logo. The simplistic design of the dispensing closure 10 allows for easy production of dispensing closures of different shapes and sizes. The living hinge design allows for less stress during the molding process, which may be further simplified by using modular tooling. In addition, since product will be flexed during the in-mold closing step before it is ejected from tool, the hinges will always be flexed at the same time, thus eliminating the variance with a lag in time until lid is actually closed.

Also disclosed is a container assembly. The container assembly includes a container having a dispensing opening and a one-piece dispensing closure attached to said dispensing opening. The one-piece dispensing closure includes a base; a lid having a first flap, a first living hinge connecting the base to the lid, and a second living hinge connecting the first flap to the lid.

In one embodiment, the one-piece dispensing closure is reversibly attached to the container.

In another embodiment, the one-piece dispensing closure is irreversibly attached to the container.

In another embodiment, the lid further includes a second flap connected to the lid by a third living hinge.

In another embodiment, the lid further includes attaching means to irreversibly attach the lid to the base.

In a related embodiment, the attaching means includes a positive snap lock on the lid and a matching hole on the base.

In another embodiment, the base includes an end wall with at least one opening on the end wall and a skirt extending downward from the periphery of the end wall.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. For example, the invention, besides being employed with screw-on caps such as disclosed herein, can also be employed with friction or adhesive retained or snap-on closures that fit on or in a container. Accordingly, the patent is not to be limited in scope and effect to the specific embodiments herein shown and described nor in any other way that is inconsistent with the extent to which the progress in the art has been advanced by the invention.

What is claimed is:

1. A one-piece dispensing closure, comprising:

a base comprising an end wall and a skirt that depends from the end wall;

a lid having a first surface free of any structure components, the lid comprising a first flap that opens and closes over a plurality of openings, wherein the lid further comprises positive snap locks formed in a chordal area of the lid, the positive snap locks extending from a second surface of the lid to engage with corresponding locking features on the base to irreversibly attach the lid to the base;

a first living hinge connecting the base to the lid;

a second living hinge connecting the first flap to the lid; and a snap-bead structure that releasably holds the first flap closed on the end wall, the snap bead structure comprising:

an edge defined between a periphery of the end wall and an exterior wall of the skirt and located opposite the first living hinge, wherein the edge extends over the skirt and surrounds at least a portion of the end wall; and a complementary curvature formed within the first flap and at a border of the first flap, wherein the complementary curvature projects upward, away from the base, wherein a lower portion of the complementary curvature snap catches the edge when the first flap is in a closed position.

2. The one-piece dispensing closure of claim 1, wherein the attaching means comprises a positive snap lock on the lid and a matching hole on the base.

3. The one-piece dispensing closure of claim 1, wherein the end wall comprises at least one opening; and wherein the skirt extends downward from the periphery of the end wall.

4. The one-piece dispensing closure of claim 3, wherein the skirt comprises internal threads.

5. The one-piece dispensing closure of claim 3, wherein the end wall comprises a pouring opening and a plurality of shake openings, wherein the pouring opening is larger than the shake openings.

6. The one-piece dispensing closure of claim 1, wherein the base further comprises a thumbtab on the skirt to facilitate a release of the first flap from the closed position.

7. The one-piece dispensing closure of claim 1, wherein the lid further comprises a second flap connected to the lid by a third living hinge.

8. The one-piece dispensing closure of claim 7, wherein the first flap and the second flap are the same size and shape.

9. The one-piece dispensing closure of claim 7, wherein the first flap and the second flap are different in size.

10. The one-piece dispensing closure of claim 7, wherein the lid further comprises a third flap connected to the lid by a fourth living hinge.

11. The one-piece dispensing closure of claim 10, wherein the lid further comprises a fourth flap connected to the lid by a fifth living hinge.

12. A container assembly, comprising:

a container comprising a dispensing opening; and a one-piece dispensing closure attached to the dispensing opening, the one-piece dispensing closure comprising:

a base comprising an end wall and a skirt that depends from the end wall;

a lid having a first surface free of any structure components, the lid comprising a first flap that opens and closes over a plurality of openings, wherein the lid further comprises positive snap locks formed in a chordal area of the lid, the positive snap locks extending from a second surface of the lid to engage with corresponding locking features on the base to irreversibly attach the lid to the base;

a first living hinge connecting the base to the lid;

a second living hinge connecting the first flap to the lid; and a snap-bead structure that releasably holds the first flap closed on the end wall, the snap bead structure comprising:

an edge defined between a periphery of the end wall and an exterior wall of the skirt and located opposite the first living hinge, wherein the edge extends over the skirt and surrounds at least a portion of the end wall; and an indentation formed within the first flap and at a border of the first flap, wherein the indentation projects upward, away from the base and is complementary to the edge, wherein a lower section of the indentation snap catches the edge when the first flap is in a closed position.

13. The container assembly of claim 12, wherein the one-piece dispensing closure is reversibly attached to the container.

14. The container assembly of claim 12, wherein the lid further comprises a second flap connected to the lid by a third living hinge.

15. The container assembly of claim 12, wherein the end wall comprises at least one opening; and the skirt extends downward from the periphery of the end wall.

16. The container assembly of claim 12, further comprising a thumbtab on the skirt, the thumbtab is configured to facilitate release of the first flap.

* * * * *